US006178559B1

(12) United States Patent
Dennis et al.

(10) Patent No.: US 6,178,559 B1
(45) Date of Patent: Jan. 30, 2001

(54) UNDERGARMENT WITH CARRYING POCKETS

(76) Inventors: Irvin N. Dennis; Nancy E. Dennis, both of 250 Dogwood Acres Rd., Fort Mill, SC (US) 29715

( * ) Notice: Under 35 U.S.C. 154(b), the term of this patent shall be extended for 0 days.

(21) Appl. No.: 09/535,566

(22) Filed: Mar. 27, 2000

(51) Int. Cl.[7] ..... A41B 9/00

(52) U.S. Cl. ..... 2/400; 2/406; 2/403; 2/114; 450/150

(58) Field of Search ..... 2/69, 78.1, 73, 2/78.2, 78.3, 114, 247, 400, 249, 402, 250, 403, 404, 405, 406, 407, 408, 228, 238, 466, 456; 602/67–73; 604/332, 345, 350–353; 450/150

(56) References Cited

U.S. PATENT DOCUMENTS 1,397,570 * 11/1921 Bott ..... 450/150
2,691,375 * 10/1954 Tasse ..... 2/406
2,778,362 * 1/1957 Pollock et al. ..... 2/406
3,421,505 * 1/1969 Freeman et al. ..... 2/406
4,533,355 * 8/1985 Fair ..... 2/400 X
5,093,935 3/1992 Countee, Jr. .
5,144,694 * 9/1992 DaOoud et al. ..... 2/69
5,172,430 12/1992 Lerma-Solis .
5,255,392 10/1993 Stanislaw .
5,551,091 * 9/1996 Tyndall ..... 2/227
5,920,914 7/1999 Dempsey .

* cited by examiner

*Primary Examiner*—Gloria M. Hale
(74) *Attorney, Agent, or Firm*—Henderson & Sturm LLP

(57) ABSTRACT

An undergarment including a pair of pockets disposed on the legs at a level below the central crotch. One of the pockets is adapted to receive and carry a drug bag, and the other pocket is adapted to receive and carry a pump operably attached to the drug bag. The embodiment for female use has the pockets on the inside section of the legs below the level of the crotch, and the embodiment for male use has the pockets on the outside section of the legs below the level of the crotch. The undergarment eliminates the need for a shoulder bag or waist pack to carry the drug bag and pump used by individuals on chemotherapy, heart muscle drugs, or other medication.

4 Claims, 1 Drawing Sheet

UNDERGARMENT WITH CARRYING POCKETS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of clothing, and more particularly with an undergarment with carrying pockets.

2. Description of Related Art

As can be seen by reference to the following U.S. Pat. Nos. 5,093,935; 5,172,430; 5,255,392 and 5,920,914 the prior art is replete with myriad and diverse undergarments with pockets.

While all of the aforementioned prior art constructions are more than adequate for the basic purpose and function for which they have been specifically designed, they are uniformly deficient with respect to their failure to provide a simple, efficient, and practical undergarment with carrying pockets for a drug bag and pumper.

As a consequence of the foregoing situation, there has existed a longstanding need for a new and improved undergarment with carrying pockets and the provision of such a construction is a stated objective of the present invention.

BRIEF SUMMARY OF THE INVENTION

Briefly stated, the present invention provides an undergarment including a pair of pockets disposed on the legs at a level below the central crotch. One of the pockets is adapted to receive and carry a drug bag, and the other pocket is adapted to receive and carry a pump operably attached to the drug bag. The embodiment for female use has the pockets on the inside section of the legs below the level of the crotch, and the embodiment for male use has the pockets on the outside section of the legs below the level of the crotch. The female version with inside pockets would also come with the option of thigh pockets. Likewise, the male version with thigh pockets would come with an option for pockets where desired. The undergarment eliminates the need for a shoulder bag or waist pack to carry the drug bag and pump used by individuals on chemotherapy, heart muscle drugs, or other medication.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
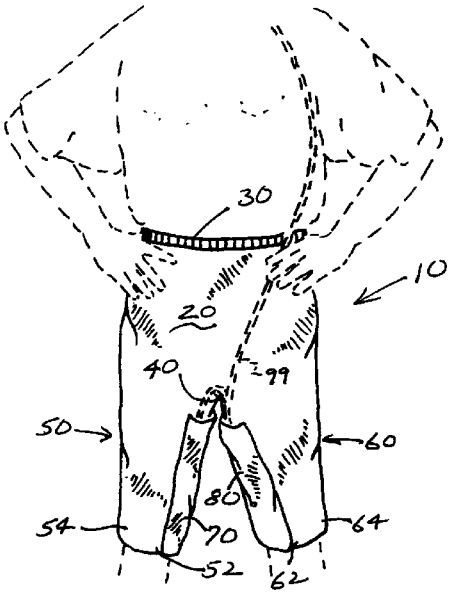
FIG. 1 is a perspective view showing the undergarment of the present invention suitable for a female user.
Figure 3:
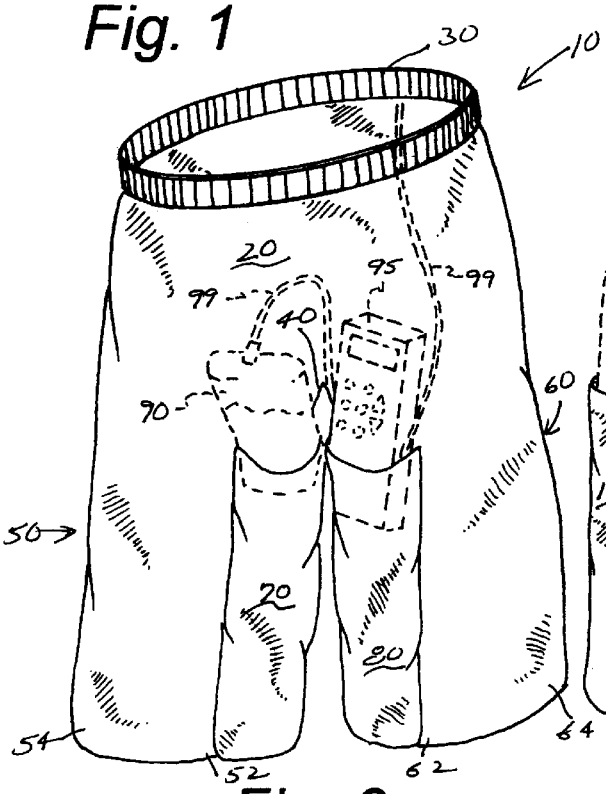
FIG. 3 is a perspective view of the female embodiment of the undergarment with the drug bag and attached pump being inserted into the pockets on the inside section of the legs below the level of the crotch.

As can be seen by reference to the drawings, and in particularly to FIGS. 1 and 3, the undergarment that forms the basis of the present invention is designated generally by the reference number 10. The undergarment 10 comprises a torso surrounding web 20 formed with an elastomeric waistband 30, and including first and second leg openings divided by a central crotch 40. A first leg 50 extends down from the first leg opening below the crotch 40 and includes an inside section 52 and an outside section 54. A second leg 60 extends down from the second leg opening below the crotch 40 and includes an inside section 62 and an outside section 64.

A first pocket 70 is attached to the inside section 52 of first leg 50 below the level of the crotch 40 and is adapted to receive and carry a drug bag 90. A second pocket 80 is attached to the inside section 62 of the second leg 60 below the level of the crotch 40, and is adapted to receive and carry a pump 95 operably attached to the drug bag 90 by tubing 99. The undergarment 10 shown in FIGS. 1 and 3 is suitable for use by a female individual on chemotherapy or other medication.

Figure 2:
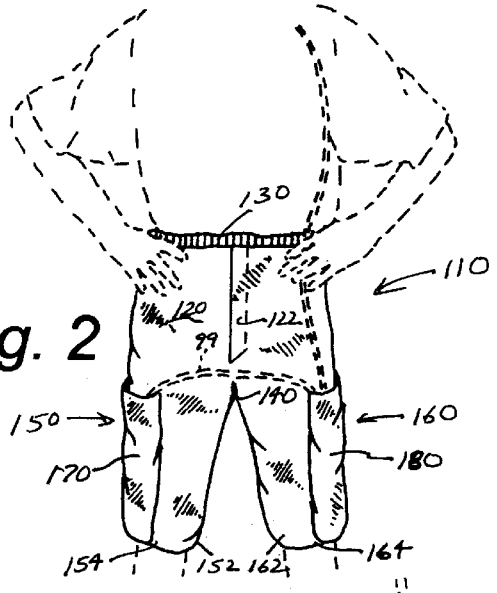
FIG. 2 is a perspective view of an alternate embodiment suitable for use by a male.
Figure 4:
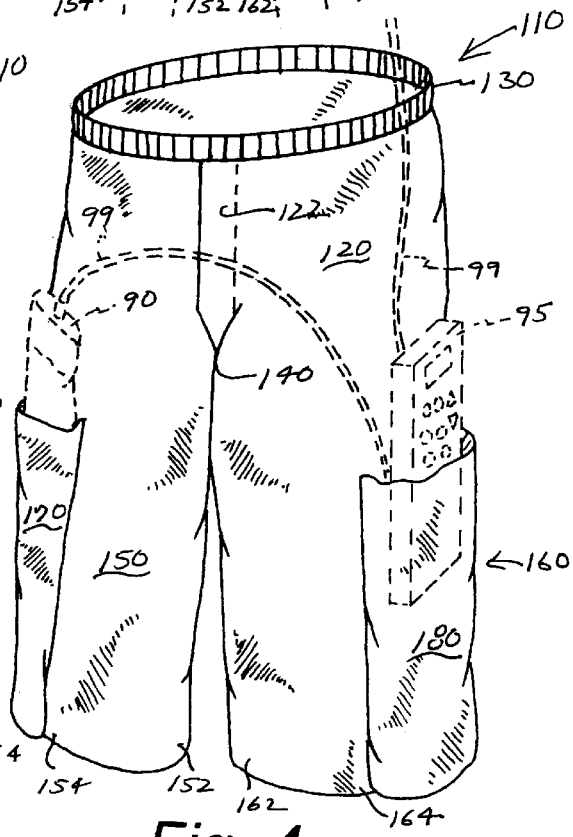
FIG. 4 is a perspective view of the male embodiment of the undergarment showing the drug bag and attached pump being inserted into the pockets on the outside section of the legs below the level of the crotch.

An alternate embodiment undergarment 110 suitable for use by a male is illustrated in FIGS. 2 and 4. The undergarment 110 includes a torso surrounding web 120 formed with a front flap opening 122, an elastomeric waistband 130, and first and second leg openings divided by a central crotch 140. First and second legs 150, 160 having inside and outside sections 152, 162, 154, 164 extend below the crotch 140. First and second pockets 170,180 are attached to the outside sections 154, 164 of legs 150, 160 below the level of the crotch 140, and are adapted to receive and carry the drug bag 90 and pump 95.

Both the female and male embodiments of the undergarment 10, 110 provide a convenient and comfortable way to carry a drug bag 90 and the operably attached pump 95 that are used by individuals on chemotherapy or other medication.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A garment, comprising:

a torso surrounding web including a first and second leg opening divided by a central crotch;

a first leg extending down from the first leg opening below the crotch, the first leg having an inside section and an outside section;

a second leg extending down from the second leg opening below the crotch, the second leg having an inside section and an outside section;

a first pocket disposed to receive and carry a drug bag, the first pocket being disposed on the inside section of the first leg at a position below the level of the crotch; and a second pocket disposed to receive and carry a pump operably attached to the drug bag, the second pocket being disposed on the inside section of the second leg at a position below the level of the crotch.

2. A garment for individuals requiring intravenous medication, comprising:

a torso surrounding web and including a first and second leg opening divided by a central crotch, a first leg extending down from the first leg opening below the crotch, the first leg having an inside section and an outside section;

a second leg extending down from the second leg opening below the crotch, the second leg having an inside section and an outside section;

a drug bag carrying a quantity of medication;

a first pocket disposed to receive and carry the drug bag, the first pocket being disposed on the first leg at a position below the level of the crotch;

a pump operably attached to the drug bag; and a second pocket disposed to receive and carry the pump, the second pocket being disposed on the second leg at a position below the level of the crotch.

3. The garment of claim 2 wherein the first pocket is disposed on the inside section of the first leg, and the second pocket is disposed on the inside section of the second leg.

4. The garment of claim 1 wherein the first pocket is disposed on the outside section of the first leg, and the second pocket is disposed on the outside section of the second leg.

* * * * *